US005411043A

United States Patent [19]

Kamler

[11] Patent Number: 5,411,043

[45] Date of Patent: May 2, 1995

[54] ARTICULATED ANNULAR SLUDGE LANCE

[75] Inventor: Frank Kamler, Kitchener, Canada

[73] Assignee: The Babcock & Wilcox Company, New Orleans, La.

[21] Appl. No.: 126,453

[22] Filed: Sep. 24, 1993

[51] Int. Cl.[6] ..... B08B 9/00

[52] U.S. Cl. ..... 134/167 R; 134/172; 134/181; 122/392; 239/752

[58] Field of Search ..... 134/167 R, 172, 180, 134/181; 122/382, 379, 392; 239/752, 753

[56] References Cited

U.S. PATENT DOCUMENTS

| | | | |
|---|---|---|---|
| 4,424,769 | 1/1984 | Charamathieu et al. | 122/392 |
| 4,638,667 | 1/1987 | Zimmer et al. | 414/749 |
| 4,980,120 | 12/1990 | Bowman et al. | 122/392 |
| 5,036,871 | 8/1991 | Ruggieri et al. | 134/200 X |
| 5,065,703 | 11/1991 | Lee | 134/172 |
| 5,172,653 | 12/1992 | Vadakin | 134/166 C |
| 5,201,281 | 4/1993 | Cella | 134/167 R |

FOREIGN PATENT DOCUMENTS

| | | | |
|---|---|---|---|
| 650678 | 3/1979 | U.S.S.R. | 134/167 R |

*Primary Examiner*—Frankie L. Stinson
*Attorney, Agent, or Firm*—Daniel S. Kalka; Robert J. Edwards

[57] ABSTRACT

An articulated annular sludge lance and method is described for cleaning sludge from tubes in a steam generator from the annular chamber surrounding the tube bundle. The articulated annular sludge lance is moved around the annular chamber and directs a fluid distribution member between the tubes to effectively clean sludge from the tubes. The articulated annular sludge lance and method can also be used in the no tube lane or in combination with a no-tube lane method.

11 Claims, 8 Drawing Sheets

ARTICULATED ANNULAR SLUDGE LANCE

BACKGROUND OF 1HE INVENTION

1. Field of the Invention

The present invention relates, in general, to equipment for cleaning steam generators and, in particular, to an articulated annular fluid lance and method for cleaning sludge from steam generator tubes from the annular chamber of the steam generator.

2. Description of the Related Art

In nuclear power stations, steam generators, such as recirculating steam generators and once-through steam generators, are used for heat exchange purposes in the generation of steam to drive the turbines. Primary fluid which is heated by the core of the nuclear reactor passes through a bundle of robes in the steam generator. Secondary fluid, generally water, which is fed into the space surrounding the robes, receives heat from the tubes and is converted into steam for driving the turbines. After cooling and condensation has occurred, the secondary fluid is directed back into the space around the tubes to provide a continuous steam generation cycle. Due to the constant high temperature and severe operating conditions, sludge accumulates on the lower portions of the tubes and on the tubesheet which supports same. The sludge which is mainly comprised of an iron oxide, such as magnetite, reduces the heat transfer efficiency of the tubes and can cause corrosion. Thus, the tubes must be cleaned periodically to remove the sludge and various types of apparatus and methods are available to accomplish this task.

U.S. Pat. No. 4,566,406 entitled "Sludge Removing Apparatus for a Steam Generator" discloses a manifold which is rigidly attached to the tubesheet and remains in place during conventional operation of the steam on the upper surface of the tubesheet. Openings are provided in the walls of the steam generator to remove the slurry.

U.S. Pat. No. 4,079,701 entitled "Steam Generator Sludge Removal System" discloses an arrangement of headers at the elevation of the sludge to be removed from around the tubes in order to establish a circumferential fluid stream at that elevation. A fluid lance moved along a line between the headers emits a fluid jet perpendicular to the line of movement of the fluid lance. The lance may also be rotated as it is removed.

U.S. Pat. No. 4,700,662 entitled "Sludge Lance Wand" discloses a lance for cleaning once-through steam generator tubes. The lance has a fixed radius of curvature thus necessitating manual manipulation of same in order to insert the lance between tubes within the tube bundle in the steam generator.

U.S. Pat. No. 4,980,120 entitled "Articulated Sludge Lance" assigned to the assignee of the present invention, and hereby incorporated by reference, discloses an articulated lance for cleaning sludge located between steam generator tubes. In operation, the lance is inserted through a handhole into a lane or space between tubes in a tube bundle.

U.S. Pat. No. 5,194,217 entitled "Articulated Sludge Lance with a Movable Extension Nozzle" is also assigned to the assignee of the present invention, and hereby incorporated by reference, discloses an articulated sludge lance with a retractable movable extension nozzle.

In addition, U.S. Pat. No. 4,980,120 in the background art section describes various other techniques found in U.S. Pat. Nos. 4,556,406; 4,079,701 and 4,700,662.

In addition to those references, U.S. Pat. No. 4,407,236 to Schukei, et all discloses a thin strip of spring steel which enters a tube lane for sludge lance cleaning for nuclear steam generators. The forward ends of the capillary tubes are directed downward for the jetting of fluid trader high pressure.

U.S. Pat. No. 4,827,953 to Lee is directed to a flexible lance for steam generator secondary side sludge removal. This patent discloses a flexible lance having a plurality of hollow, flexible tubes extending lengthwise along the flexible member. There are a plurality of nozzles at an end of the flexible members with the flexible member being configured to go into the difficult to access geometry of the steam generator.

In a steam generator, there are tie rods which assist in retaining support plates. These tie rods prevent a vast area between tubes from being cleaned from the no-tube lane with prior art methods.

Thus, there is a need for an annular sludge lancing method and apparatus which would enter the steam generator in any one of the handholes and be manipulated in the annular chamber to clean tubes therefrom. It is desirable for the apparatus and method to work in combination with no-tube lane cleaning methods to provide the largest cleaning area possible.

SUMMARY OF THE INVENTION

The present invention solves the aforementioned problems associated with the prior art as well as others by providing an annular articulated sludge lance and method for cleaning a steam generator from the annular chamber or annulus surrounding the tube bundle of a steam generator.

The method of the present invention removes sludge located between the plurality of tubes within the steam generator by positioning the articulated annular sludge lance with a manipulator member having a plurality of track members attached to the manipulator member in any handhole of the steam generator. The track members form an arc in the annular chamber of the steam generator which permits the articulated annular sludge lance to move therein. A manipulator head of the articulated sludge lance positions a fluid member at a selected angle to inject a fluid stream between the tubes to remove sludge therefrom.

The lance of the present invention removes sludge located between tubes of the tube bundle in a steam generator using a delivery rail with a plurality of track members movably connected to each other and directed by the delivery rail. The track members are constructed to extend into the annular chamber of the steam generator. A manipulator head is attached to one end of the track members for positioning a fluid member to inject fluid at a selected angle between the tubes of the steam generator. Positioning means attached to the manipulator head directs the manipulator head along the annular chamber and positions it to direct the fluid member between the tubes.

Accordingly, an object of the present invention is to provide an annular articulated sludge lance which cleans the tubes in a steam generator from the annular chamber of the steam generator.

Another object of the present invention is to provide a method for cleaning a steam generator from the annulus or annular chamber of the steam generator.

Still a further object of the present invention is to provide a method which allows tubes in the tube bundle of the steam generator to be cleaned even where tie rods block access from the no-tube lane.

A further object of the present invention is to provide a method for cleaning a steam generator from the annular chamber which allows for cleaning from the no-tube lane in addition to the annular chamber.

Still a further object of the present invention is to provide an annular articulated sludge lance which is simple in design, rugged in construction, and economical to manufacture.

The various features of novelty characterizing the invention are pointed out with particularity in the claims annexed to and forming a part of this disclosure. For a better understanding of the invention, the operating advantages attained by its uses, reference is made to the accompanying drawings and descriptive matter in which a preferred embodiment of the invention is illustrated.

Figure 2A:
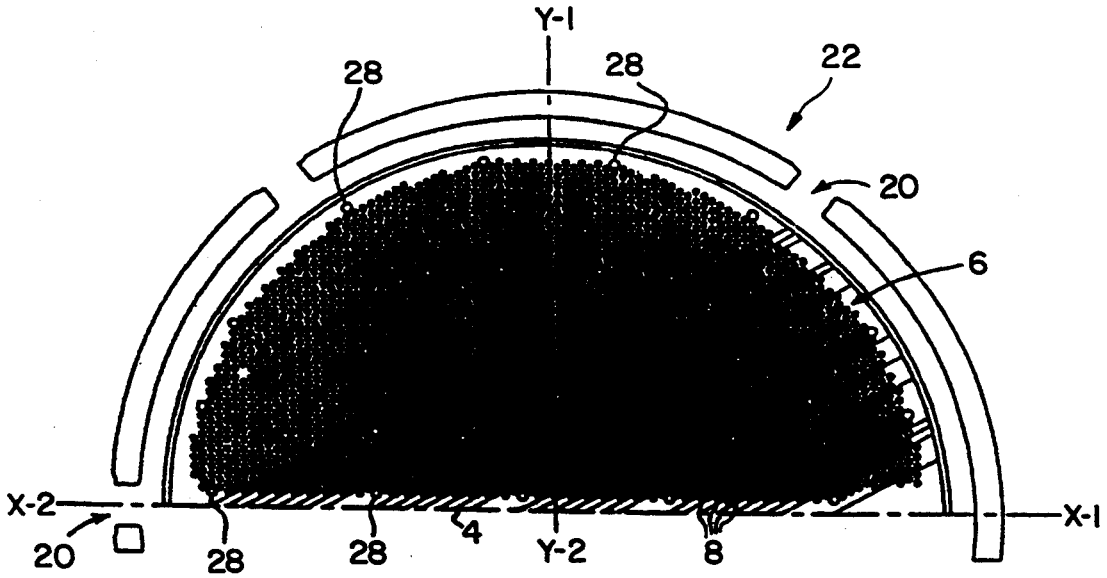
Figure 2B:
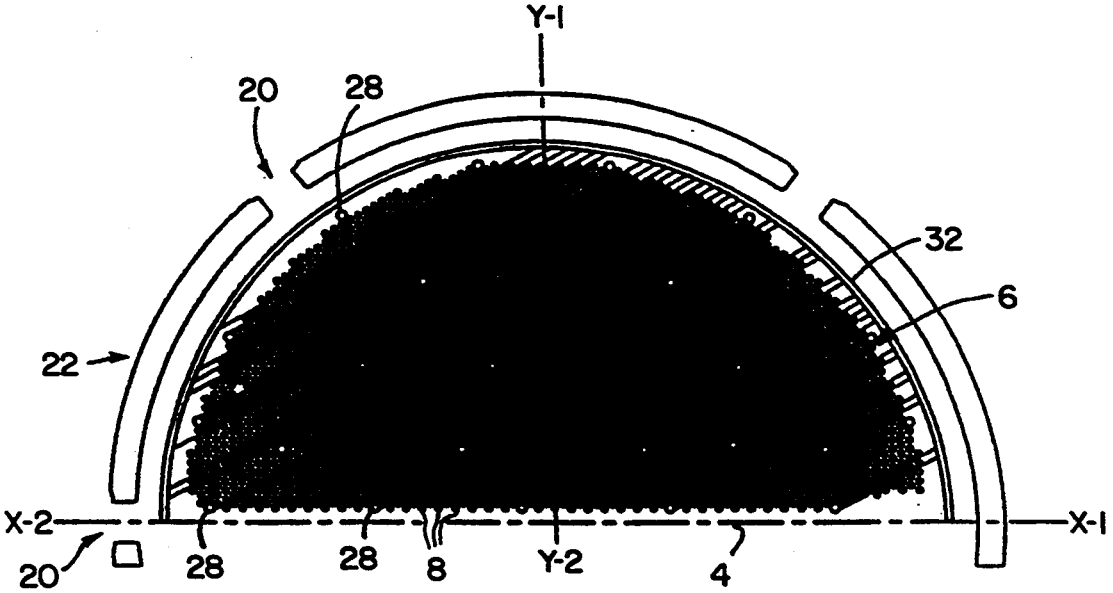
Figure 5:
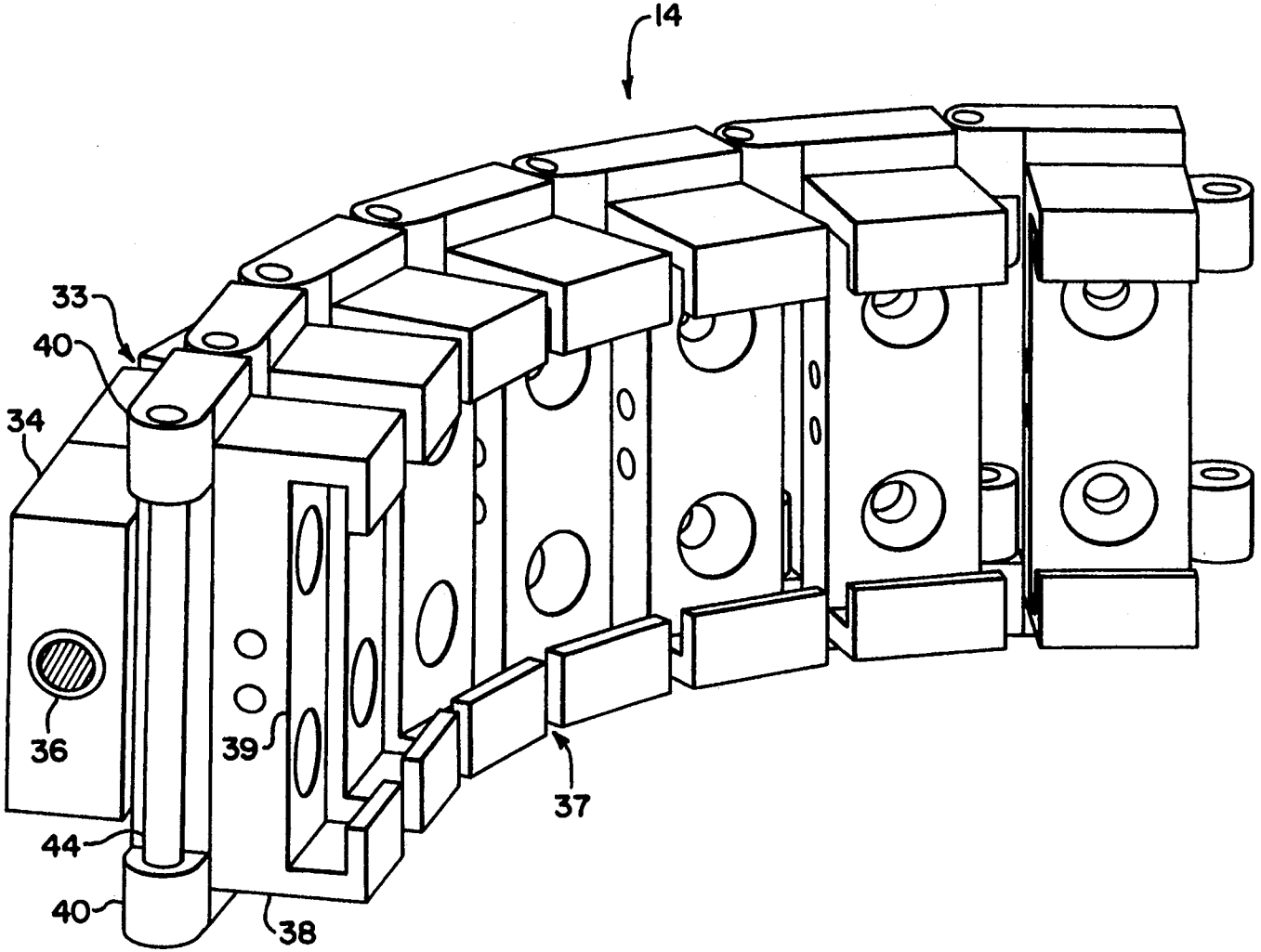
Figure 6:
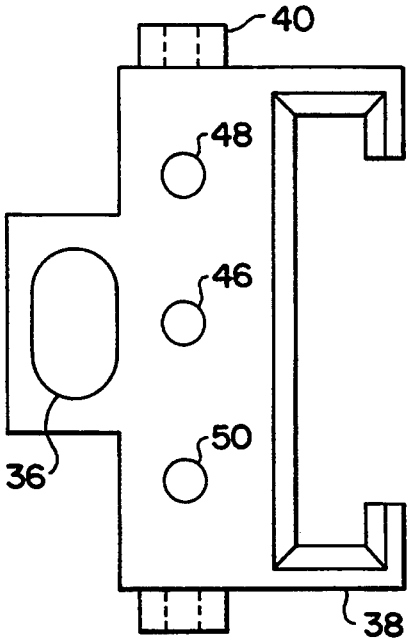
Figure 7:
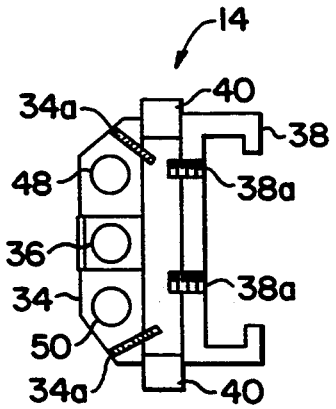
Figure 8:
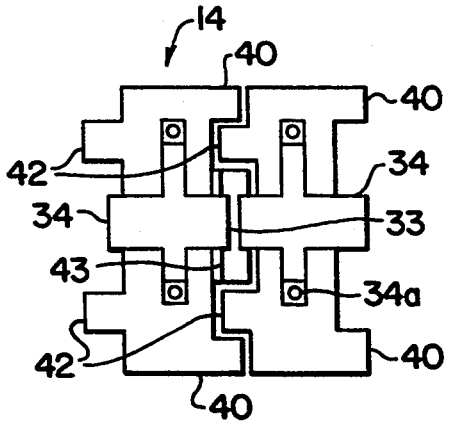
Figure 9:
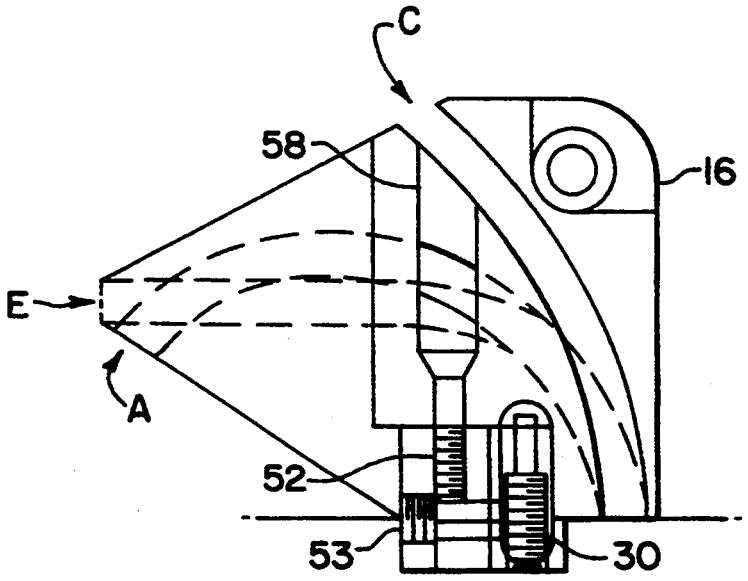
Figure 10:
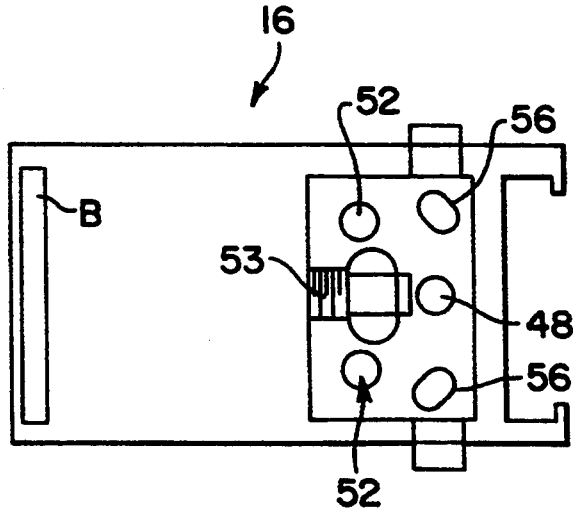
Figure 11:
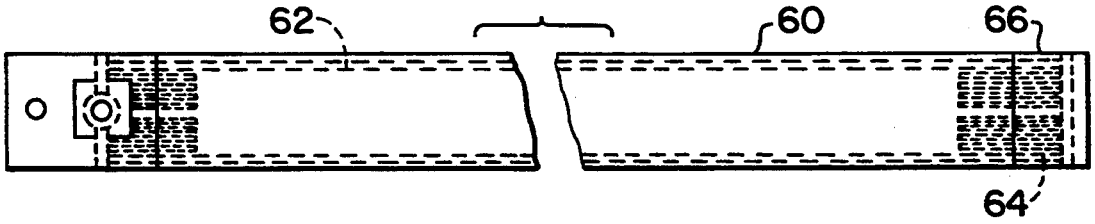
FIG. 11 PRIOR ART
Figure 12:
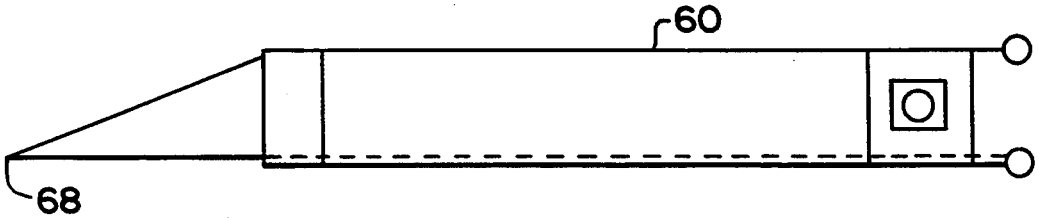
FIG. 12 PRIOR ART

FIG. *2a* is partial cross-sectional view of a steam generator showing with dark lines the 30° lancing coverage from the no-robe lane (NTL) and handhole;

FIG. *2b* is a view similar to FIG. 2 showing 30° lancing coverage from the 130° handhole;

FIG. *3a* is a view similar to FIG. 2 and shows 90° lancing coverage with dark lines from the no-robe lane handhole using the annular articulated sludge lance according to the present invention;

FIG. *3b* is a view similar to *3a* showing 90° lancing coverage with dark lines from both the 50° and 130° handholes using the annular articulated sludge lance according to the present invention;

FIG. *4a* is a view similar to the preceding views showing 30° lancing coverage with dark lines from the 50° handhole;

FIG. *4b* is a view similar to the preceding views showing total lancing coverage with dark lines from all handholes using a combination of the annular articulated sludge lance cleaning from the annular chamber of the steam generator and cleaning from the no-robe lane according to one method of the present invention;

FIG. 5 is a front elevational view of a portion of the track members of the articulated annular sludge lance according to the present invention;

FIG. 6 is a vertical sectional view of one track member adjacent the manipulator head;

FIG. 7 is a vertical sectional view of a track member;

FIG. 8 is an elevated perspective view of one side of two track members joined together FIG. 9 is a top sectional view of the manipulator head showing three selected angles for the fluid member with two of the selected angles in dashed lines;

FIG. 10 is a front view of the manipulator head with the rear portion sectionally removed according to the present invention;

FIG. 11 is a side view of the fluid distribution member utilized by the articulated annular sludge lance; and FIG. 12 is an elevational sectional view of an alternate embodiment of the fluid distribution member illustrating the extension nozzle.

DESCRIPTION OF THE PREFERRED EMBODIMENTS

Figure 1:
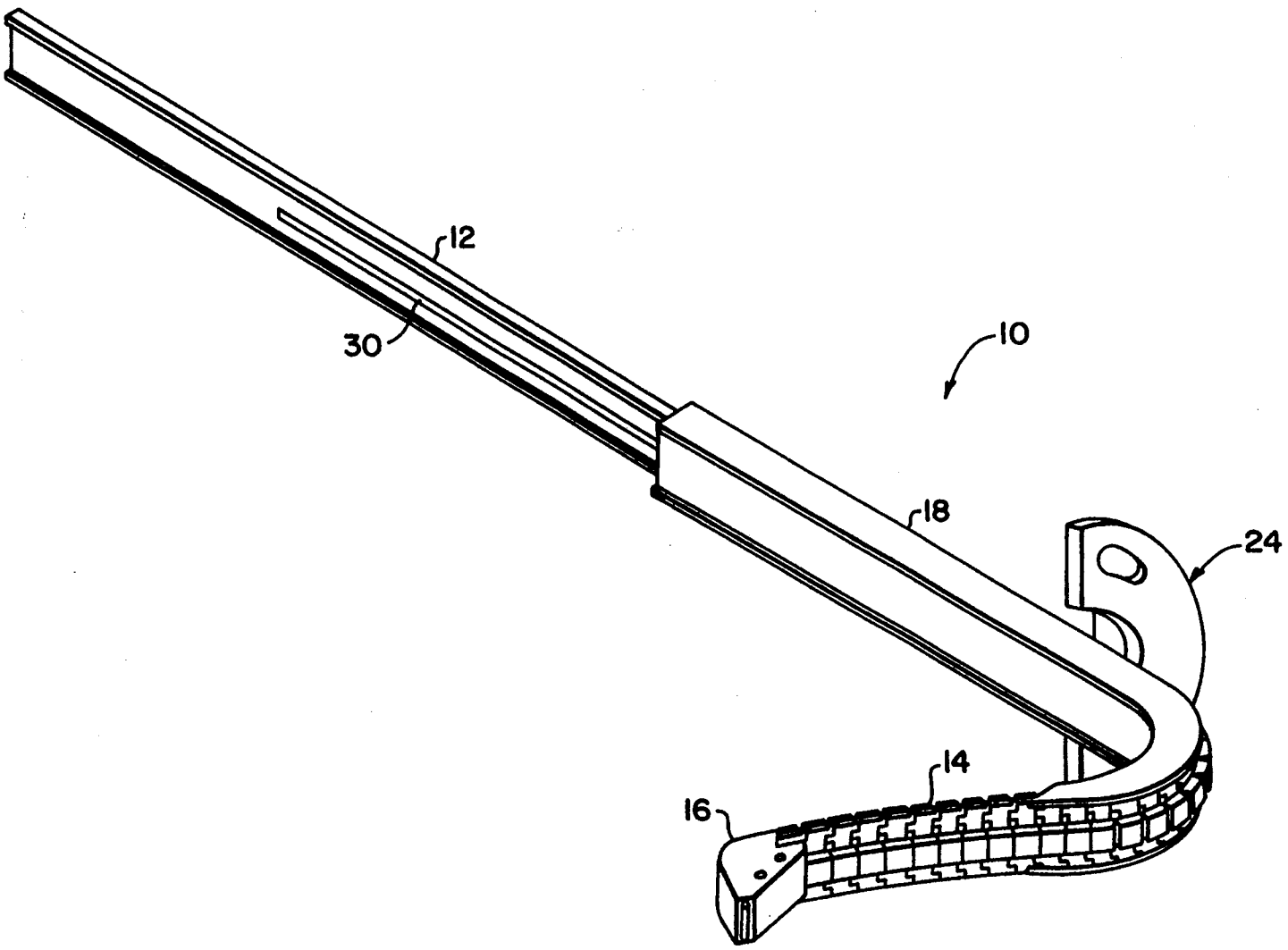
FIG. 1 is a perspective view of the present invention illustrating the articulated annular sludge lance.

Referring to the figures generally, where like numerals designate like or similar features throughout the several drawings, and first to FIG. 1 in particular, there is shown the articulated annular sludge lance 10 according to the present invention. The articulated annular sludge lance 10 preferably includes a flexible manipulator 12 connected to a plurality of track members 14 with an interchangeable manipulator head 16 pivotally attached to the last track member 14.

The plurality of track members 14 are pivotally connected to each other to form a flexible and extendable manipulator belt. Delivery rail 18 acts as a track or channel to guide the annular articulated sludge lance 10 into any handhole 20 of a steam generator 22. Optionally, a mounting bracket 24 may be fastened over the existing bracket surrounding a handhole 20 to facilitate entry of the articulated annular sludge lance 10 into the annulus or annular chamber 26 of steam generator 22.

The articulated annular sludge lance of the present invention unlike the sludge lances disclosed in U.S. Pat. No. 4,980,120 and U.S. Pat. No. 5,194,217, both assigned to the assignee of the present invention, and other prior art lances cleans the sludge between tubes 8 from the tube bundle 6 of the steam generator 22 directly from the annular chamber 26 by directing a fluid distribution member 60 to inject a fluid at a high pressure between the tubes 8. The lance of the present invention is constructed to extend around the annular chamber 26 with the interchangeable manipulator head 16 guiding the fluid distribution member 60 at a selected angle to inject fluid with the preferred angles being about 120°, 90°, and 30° to clean the tubes shown in FIGS. 2–4 in a fashion represented by dark lines. This provides total lance coverage shown in FIG. *4b* which heretofore has been unattainable with prior art methods. Of course, the manipulator head 16 may be constructed to be adjustable to any selected angle between 0°–120°.

Advantageously, as shown in FIGS. 2 and *3a*, the articulated ,annular sludge lance may also be employed in the no-tube lane 4 to clean at any selected angle as shown in FIGS. *2a* and *3a*.

Figure 3A:
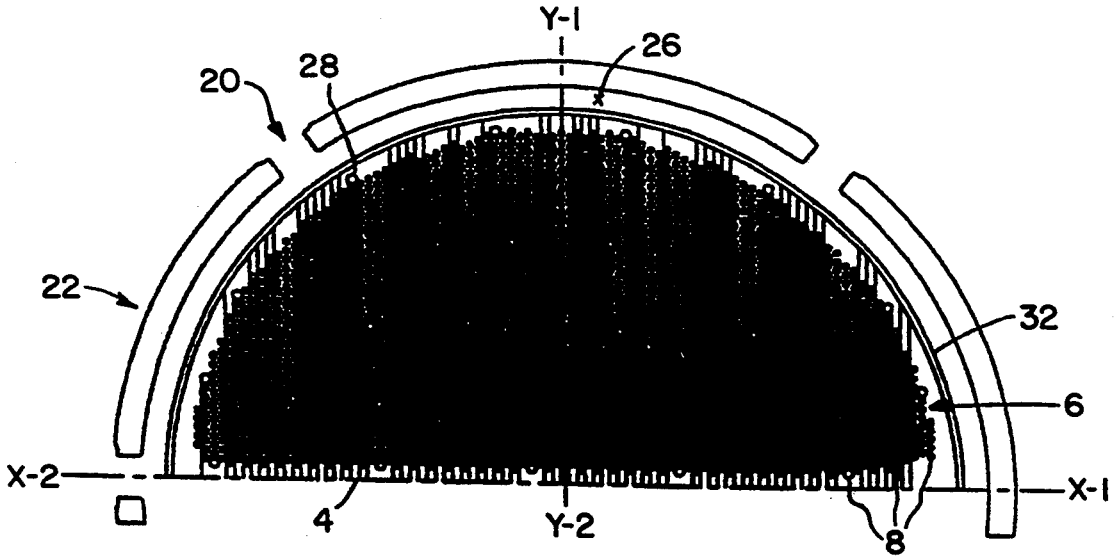
Figure 3B:
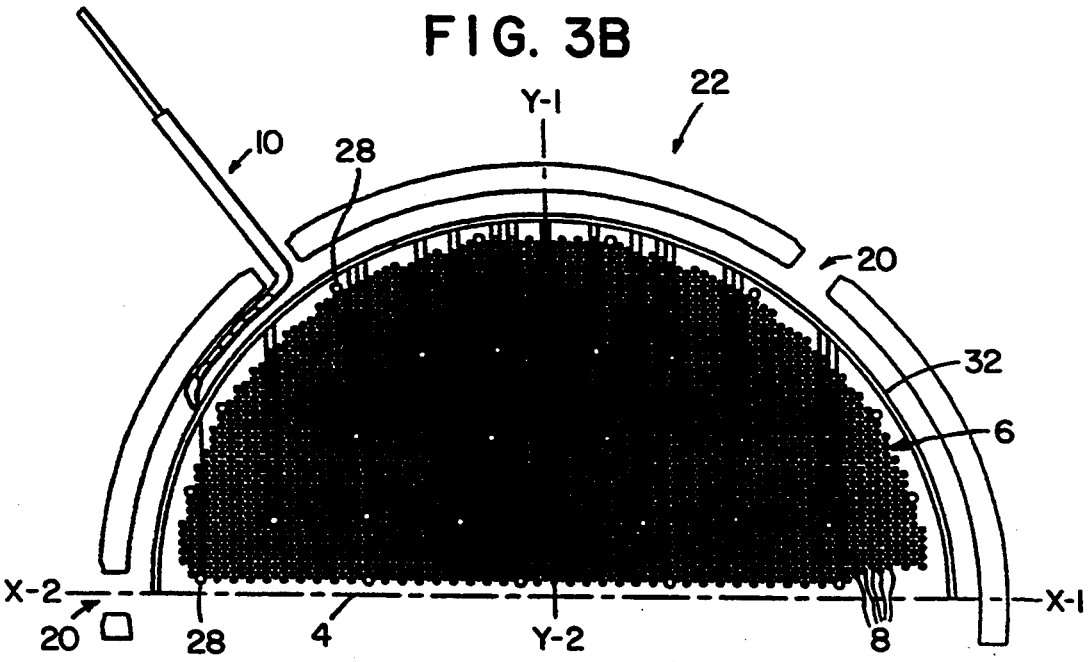
Figure 4A:
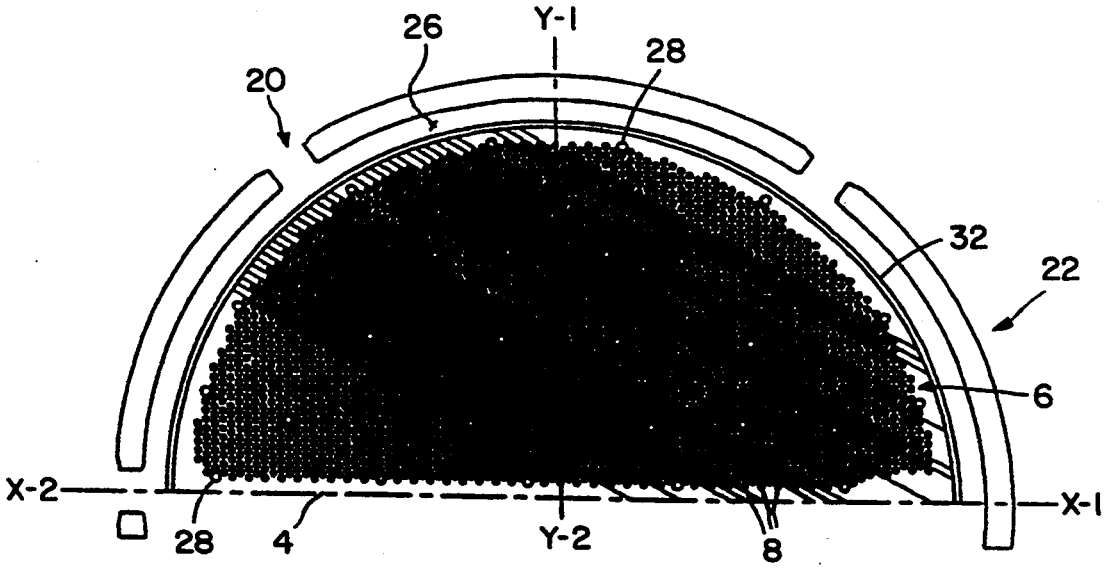
Figure 4B:
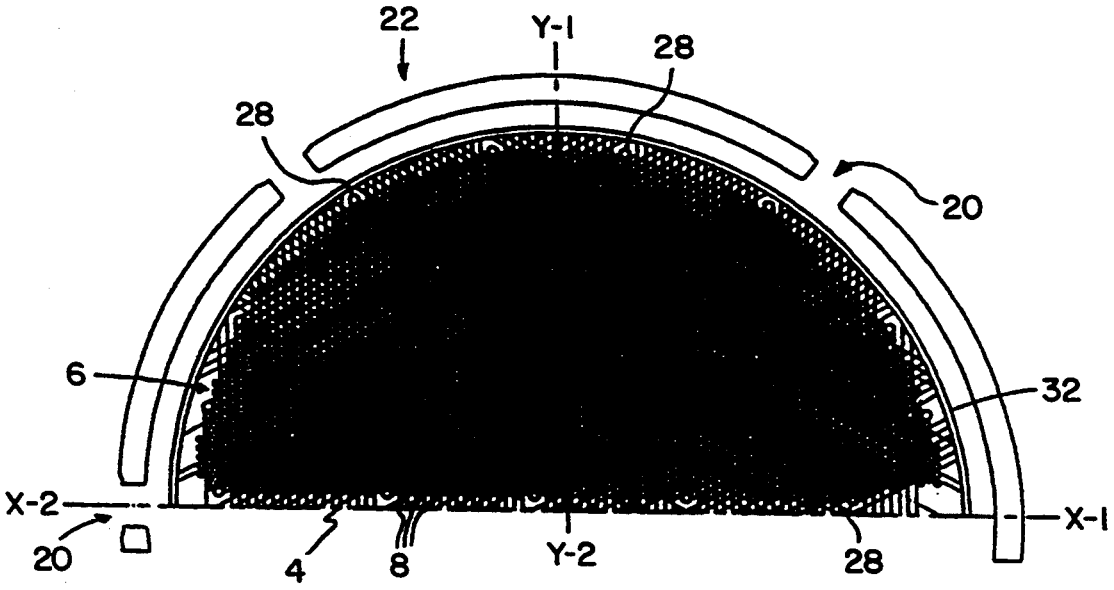

In fabricating a steam generator, tie rods 28 are used to retain the support plates. Normally, the tie rods 28 are three-quarter inch steel members which after fabrication of the steam generator can block a lance from cleaning between the tubes as shown in FIGS. 2–4. FIG. *3a* with light shade shows that the tubes 8 are inaccessible, i.e., blocked by tie rods 28 from the no-tube lane 4. Because of the number of the tie rods 28 in a steam generator, a vast area of the steam generator remains uncleaned with prior art techniques. The method and lance of the present invention provide a far more effective cleaning of sludge from between the tubes 8 in steam generator 22 as best seen in FIG. *4b*.

Returning to FIG. 1, a positioning cable 30 is employed for positioning the manipulator head 16 in the annular chamber 26 to direct a fluid distribution member 60 to inject a fluid such as a high pressure stream of water between the tubes 8. Positioning means 30 can also be employed for making the lance rigid when the lance is employed in the no-tube lane. Alternatively, a second control cable may be used for that purpose. Positioning means 30 is a control cable which can include a handle (not shown) or be controlled automatically with a microprocessor or computer (not shown). In one embodiment, the distal end connected to the manipulator head 16 has a flat or spade-like portion for moving the manipulator head 16 vertically up and down. Positioning means 30 may be attached to a user friendly control system (not shown) such as a joystick or cam lever with cam assembly as described in U.S. Pat. Nos. 4,980,120 and 5,194,217, both which are incorporated by reference.

Like the lances described in U.S. Pat. Nos. 4,980,120 and 5,194,217, the lance of the present invention may be made from a high impact strength plastic like polycarbonate or TIVAR, and/or metals such as aluminum, stainless steel, or brass, or a combination thereof.

In some steam generators 22, there is a shroud or inner shell 32 covering the tube bundle 6 except for about an eight inch off-set from the tubesheet. As seen in FIGS. 2–4, there is one entry into the no-tube lane 4 from a handhole 20 with a diameter of about two and one-half inches. The other handholes in some steam generators have a diameter of about three and one-half inches. The annular chamber 26 is about three and one-half to four inches wide. Of course, other steam generators will differ dimensionally according to their specifications. Due to the space constraints, the lance 10 must have the ability to fit into tight places. Also, the delivery rail 18 preferably provides an axis ranging from 0° to 90° to allow the track members 14 to advance into and around the annular chamber 26 of the steam generator 22. Alternate embodiments of the present invention include the use of a single flexible track to accommodate the articulated flexible belt, or even act as the track itself still utilizing a manipulator head to direct the fluid member. The track would be positioned inside the annular chamber 26 of the steam generator 22.

Next referring to FIG. 5, there is shown a plurality of track members 14 with each member having a substantially rectangular cross section of approximately the same size. On one side of each member 14 there is a projecting portion 34 having at least one opening 36 therein at preferably an angle of about 90° to the front of the track member 14. The opposite side of each track member 14 is C-shaped 38 and together make a track or channel 39 which a fluid distribution member 60 extends through and into the manipulator head 16 into the tube bundle 6. Any suitable fluid member may be employed in the track 39. Preferably, each track member 14 has two clevis portions 40, 42 at the front and back, respectively, of each member 14. The clevis portion 40 of one track member 14 engages the other clevis portion 42 of another member with a pin 44 holding the two members together. A bushing may be used between members 14. A plurality of track members 14 are connected in this fashion to form a flexible and extendable manipulator belt as seen in FIG. 1. Track members 14 can be constructed of components which are assembled with fasteners. FIG. 7 shows a track member 14 with the C-shaped portion 38 attached to member 14 with fasteners **38*a*. Similarly, projecting portion 34 is attached with fasteners 34*a* to track member 14. Preferably, there is at least one aperture 36 in each track member 14. A safety cable may be provided in additional openings 48, 50 in case one of the pins 44 should break. Openings 48, 50 may be used for other purposes like electrical wiring for video monitoring of the cleaning. When track members 14 are connected together, each member pivotally moves. A space 37 between the C-shaped portions 38 and a space 33 between the projected portions 34 allow for pivotal movement. Thus, a greater space 37,33 allows greater pivotal movement. Space 37 should be large enough to allow track members 14 to form an arc in the annular chamber yet not be too large since C-shaped portions 38 support the fluid member 60. FIG. 8 shows two track members 14 engaged together by clevis portions 40, 42. A bushing 43 is positioned on pin 44 between members. The projecting portion 34** is preferably cross shaped to provide flexibility and rigidity when necessary.

Preferably, a couple of track members 14 adjacent the manipulator head 16 have a cross-section shown in FIG. 6 and are formed as one piece from aluminum. The larger opening 36 accommodates bending movement of control cable 30. Additional openings 46-50 are optionally provided in the body of the member 14.

The manipulator head 16 is movably fastened to the last track member 14 by at least one listener 52. FIG. 9 is a top cross sectional view of the manipulator head 16 and shows the various selected angles A, B, C which the fluid member 60 is received and directed into the tube bundle 6. As mentioned earlier, the selected angle can range from 0-120°, but preferably the angles are A=120°, B=90° and C=30° with removable (interchangeable) manipulator heads to allow for the different angles. The safety cable which passes through the opening 48 in the track members 14 attaches to the manipulator head 16 by a fastener. Control cable 30 is securely held in place in an opening with pin 53. Guide pins 56 on a connecting track member limit rotational movement of the manipulator head 16. Advantageously, the manipulator head 16 has a recessed groove 58 which makes removal simple and has a split body for quick installation. As mentioned earlier, the manipulator head 16 pivots vertically to clean at various levels between the tubes. Manipulator head 16 is constructed to also monitor the cleaning process with either a video camera or video fiber optics (not shown). Of course, video monitoring is not required with the present invention.

FIGS. 11 and 12 show alternate embodiments of a suitable fluid distribution member 60. Member 60 is elongated and has a substantially rectangular cross-section which is engaged by track 39 and advances therealong either by operator interaction or remotely by microprocessor or computer control. The length of the fluid distribution member 60 is greater than the combined length of the track members 14 and manipulator head 16 so that an outer end of the fluid distribution member 60 is exposed and extends between tubes 8 into the recesses of the tube bundle. When the articulated annular sludge lance is inserted in the annular chamber of the steam generator the projecting portions of the track members face the tubes, this eliminates unnecessary bending of the fluid member as it passes through the manipulator head. Fluid tubes 62 extend in fluid member 60 and terminate in a transverse passageway 64 located in a split manifold 66 at the outer end of the fluid distribution member 60. A suitable fluid distribution member is disclosed mad described in U.S. Pat. No. 4,980,120. Alternately, FIG. 10 shows another suitable fluid distribution member 60 with a retractable movable extension nozzle 68. This device is described in greater detail in U.S. Pat. No. 5,194,217.

While specific embodiments of the invention have been shown and described in detail to illustrate the application and principles of the invention, certain modifications and improvements will occur to those skilled in the art upon reading the foregoing description. It is thus understood that such modifications and improvements have been deleted herein for the sake of conciseness and readability but are properly within the scope of the following claims.

I claim:

1. A lance for removing sludge located between tubes within a steam generator, comprising:

a plurality of track members pivotally connected to each other to form a flexible and extendable manipulator belt, each of said track members having a substantially rectangular cross section and having one side being C-shaped, together said C-shaped side of said plurality of track members forming a channel, said plurality of track members being constructed to extend into and around an annular chamber of a steam generator;

a fluid distribution member engaged by said channel and constructed to advance in and through said channel out from the annular chamber between tubes in the steam generator for injecting a fluid to remove sludge;

means for manipulating said plurality of track members to extend into and around the annular chamber of the steam generator;

a manipulator head movably attached to a last track member for receiving and directing said fluid distribution member at a selected angle out from said channel formed by said plurality of track members in the annular chamber and into the steam generator between tubes of a tube bundle; and means for positioning said manipulator head in the annular chamber.

2. A lance as recited in claim 1, wherein the selected angle is about 120°.

3. A lance as recited in claim 1, wherein the selected angle is about 90°.

4. A lance as recited in claim 1, wherein the selected angle is about 30°.

5. A lance as recited in claim 1, wherein said manipulator head is removably attached to said last track member.

6. A lance as recited in claim 1, wherein each of said track members further includes a projecting portion opposite said C-shaped side with an aperture located therein, said aperture being constructed to receive a positioning cable.

7. A lance as recited in claim 6, wherein said positioning means includes a control cable situated through each of the apertures of the plurality of track members and connected to said manipulator head for positioning same.

8. A lance as recited in claim 7, wherein each of said track members includes a second opening normal to said track member for receiving a safety cable therethrough.

9. A lance as recited in claim 1, wherein each of said track members includes at least two means for connecting said track members pivotally together.

10. A lance as recited in claim 9, wherein said connecting means includes at least one clevis portion on a front and back side of each track member.

11. A lance as recited in claim 10, wherein said clevis portion on one side of one track member is constructed to engage the clevis portion on the opposite side of another track member.

* * * * *